United States Patent [19]

Berber et al.

[11] 4,228,948

[45] Oct. 21, 1980

[54] CENTRIFUGAL LIQUID CLEANER

[76] Inventors: Viktor A. Berber, Shelkovichnaya ulitsa, 184, kv. 65; Nikolai A. Khodosov, Oktyabrsky poselok, 6 linia, 36; Stanislav A. Kosygin, Shelkovichnaya ulitsa, 180, kv. 17; Vladimir I. Mozyakov, Shelkovichnaya ulitsa, 190, kv. 47; Igor M. Lapshev, ulitsa 20 let VLKSM, 21, kv. 13, all of Saratov, U.S.S.R.

[21] Appl. No.: 912,178

[22] Filed: Jun. 5, 1978

[51] Int. Cl. ..... B04B 11/06

[52] U.S. Cl. ..... 233/3; 233/31

[58] Field of Search ..... 233/3, 21, 27, 28, 29, 233/30, 31, 36, 37, 42, 43

[56] References Cited

FOREIGN PATENT DOCUMENTS 729169 5/1955 United Kingdom ..... 233/27

510022 12/1976 U.S.S.R. ..... 233/30

*Primary Examiner*—George H. Krizmanich

*Attorney, Agent, or Firm*—J. Harold Nissen

[57] ABSTRACT

A centrifugal liquid cleaner comprising a vertical hollow axle fixed immovably on a base and having a liquid inlet and outlet and carrying a cylindrical rotor made up of a bushing arranged coaxially with the hollow axle and wound spirally with a band whose adjacent turns contain spacers arranged radially one after another parallel with the hollow axle and forming, together with the band, gaps for the passage of the liquid, and impellers installed at the ends of the bushing and made in the form of discs with ribs intended for fastening the edges of the spacers. The impeller discs are made and secured in such a manner that the distance between each disc and the corresponding edge of the band helix satisfies the condition:

$$\frac{l_1}{l_2} = \frac{R^3 - r^3}{r^3 - r_0^3}$$

where:

$l_1$ = distance between the disc of one impeller and the corresponding edge of the band helix;

$l_2$ = distance between the disc of the other impeller and the corresponding edge of the band helix;

R = maximum radius of the band helix;

r = moving radius of the band helix;

$r_0$ = minimum radius of the band helix.

1 Claim, 3 Drawing Figures

CENTRIFUGAL LIQUID CLEANER

The present invention relates to liquid cleaning devices and more particularly it relates to centrifugal liquid cleaners.

The centrifugal liquid cleaner realized in accordance with the present invention will be most successfully used for cleaning liquids (oil, fuel, etc) from mechanical impurities.

Known in the prior art is a centrifugal liquid cleaner comprising a vertical hollow axle fixed rigidly on a base and provided with liquid inlet and outlet. Mounted in sliding-contact bearings on the axle is a cylindrical rotor comprising a casing, a bushing with a spirally-wound band, and lower and upper impellers located, respectively, above and under the helix.

Installed radially one after another, parallel to the axle between the adjacent turns of the band helix are spacers which form, together with the band, gaps for the passage of the liquid. The incoming liquid is delivered to, and the cleaned liquid is discharged from, the gaps through chambers formed between the impeller discs and the edges of the band helix.

Acted upon by the centrifugal force, the mechanical impurities are separated from the liquid in the gaps, and settle on the surface of the band.

In such a centrifugal cleaner the degree of cleaning liquids from mechanical impurities in the gaps formed by the band turns and the spacers is not uniform. This is attributable to the fact that the distribution of liquid flow velocities in the gaps depends on the radius of their location which impairs the degree of liquid cleaning.

An object of the present invention lies in providing a centrifugal liquid cleaner wherein the impeller discs would be so arranged relative to the edges of the band helix as to ensure an optimum distribution of the liquid flow velocities in the gaps and thus to obtain a uniform degree of liquid cleaning.

This object is accomplished by providing a centrifugal liquid cleaner comprising a vertical hollow axle fixed immovably on a base, having a liquid inlet and outlet and carrying a cylindrical rotor which comprises a bushing arranged coaxially with the hollow axle and wound spirally with a band whose adjacent turns contain spacers arranged radially one after another parallel with the hollow axle and forming, together with the band, gaps for the passage of the liquid, and impellers installed at the ends of the bushing with the band and made in the form of discs with ribs secured thereon for fastening the edges of the spacers wherein, according to the invention, the impeller discs are made and secured in such a manner that the distance between each disc and the corresponding edge of the band helix satisfies the condition:

$$\frac{l_1}{l_2} = \frac{R^3 - r^3}{r^3 - r_o^3}$$

where $l_1$ = distance between the disc of one impeller and the corresponding edge of the band helix;

$l_2$ = distance between the disc of the other impeller and the corresponding edge of the band helix;

$R_1$ = maximum radius of the band helix;

$r$ = moving radius of the band helix;

$r_o$ = minimum radius of the band helix.

The centrifugal liquid cleaner realized according to the present invention improves the degree of liquid cleaning while retaining the same capacity as that of the prior art centrifugal cleaners. Besides, the centrifugal cleaner according to the invention can work with at least twice longer intervals between the successive removals of sediment from the rotor than the prior art cleaners.

Now the invention will be described in detail by way of example with reference to the accompanying drawings in which.

Figure 1:
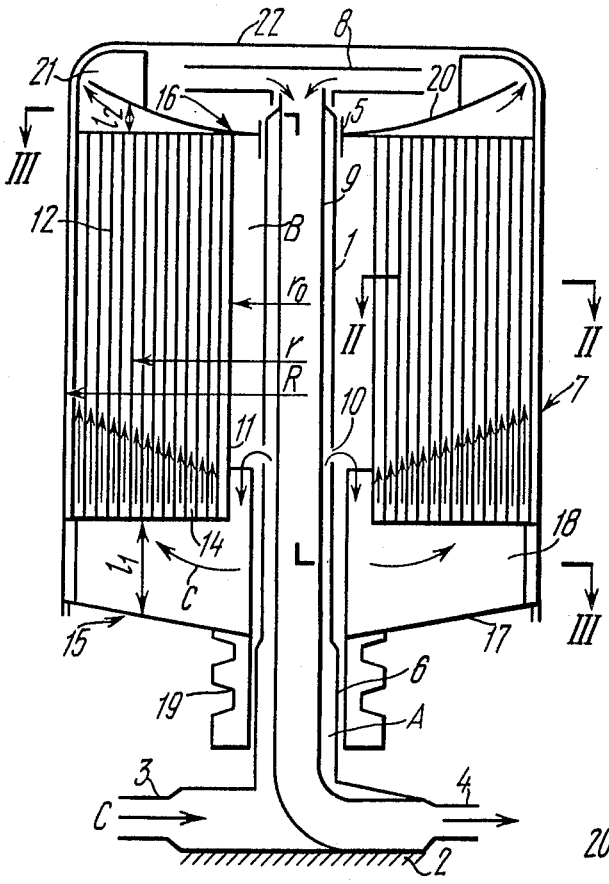
FIG. 1 is a schematic longitudinal section of the centrifugal liquid cleaner according to the invention.

The centrifugal liquid cleaner comprises a hollow axle 1 (FIG. 1) fixed immovably at the lower end on a base 2. In the lower part of chamber "A" of the axle 1 there is an inlet pipe union 3 admitting the incoming liquid into the cleaner, and an outlet pipe union 4 discharging the cleaned liquid.

Figure 3:
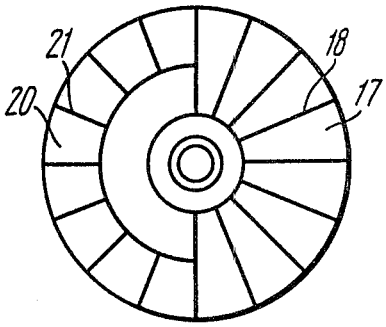
FIG. 3 is a section taken along line III—III in FIG. 1.
Figure 2:
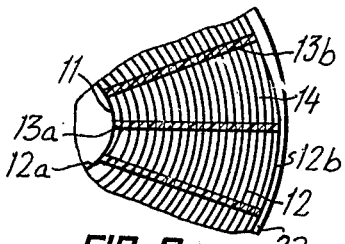
FIG. 2 shows a fragment of the cross section of the band helix a section taken along line II—II in FIG. 1.

Mounted in bearings 5 and 6 on the axle 1 is a cylindrical rotor 7 intended to rotate the liquid to be cleaned. On the upper end of the axle 1 is installed a pressure disc 8 which puts the internal chamber of the rotor 7 in communication with the pipe union 4 through a pipe 9 located inside the chamber "A" of the axle 1. The pressure disc 8 pumps the liquid and, simultaneously, serves as the upper thrust bearing of the cylindrical rotor 7. The axle 1 has holes 10 in the middle for delivering liquid into the rotor 7. The rotor comprises a bushing 11 wound spirally with a band 12; installed radially between the turns of said band one after another are spacers 13 (FIG. 2). The spacers 13 together with the turns of the band 12 form gaps 14 whose size depends on the thickness of the spacers 13. The bushing 11 is provided with a pressed-in lower impeller 15 (FIG. 1) and an upper impeller 16, both being located, respectively, under and above the helix of the band 12. The lower impeller comprises a disc 17 with ribs 18 (FIG. 3) arranged radially and uniformly around the circumference; the lower part of the disc is made in the form of a sheave 19 (FIG. 1) which connects the rotor via a V-belt transmission (not shown) with the drive (not shown). The impeller 15 serves for twisting the flow of liquid and aligning the rotor in the bearing 6.

The leading end 12*a* of the band 12 is fixed to the bushing 11 and the band is wound to form an Archimedean spiral with the help of spacers 13 (the first spacer is numbered 13*a*). The trailing end 12*b* of the band is fixed to the band 12 itself. The last spacer is numbered 13*b*.

The upper impeller 16 comprises a disc 20 which has ribs 21 (FIG. 3) equispaced radially around the circumference and serves for aligning the rotor 7 (FIG. 1) in the bearing 5 and for twisting the flow of liquid.

The edges of the spacers 13 are secured in the ribs 18 and 21 of the lower 15 and upper 16 impellers, respectively.

The liquid is delivered to the gaps 14 through chamber "B" formed by the bushing 11 and the axle 1, by the radial channels formed by the ribs 18 and disc 17 of the impeller and by the lower edge of the helix of the band 12.

The cleaned liquid is discharged from the gaps 14 through the radial channels formed by the upper edge of the helix of the band 12, the disc 20 and the ribs 21 of the impeller 16.

The rotor 7 is enclosed in a casing 22 which is secured in the disc 17 of the impeller 15.

A hole (not shown) in the upper part of the casing 22 serves for venting air when the rotor 7 is being filled with liquid.

The efficiency of the centrifugal liquid cleaner depends on the selection of the distances $l_1$ (FIG. 1) and $l_2$ located, respectively between the disc 17 of the impeller 15 and the lower edge of the helix of the band 12 and the disc 20 of the impeller 16 and the upper edge of the helix of the band 12. The relationship between those distances governs the law of distribution of liquid velocities in the gaps 14 and, consequently, the efficiency of cleaning in each gap 14.

The best distribution of liquid velocities in the gaps of the helix is the one obeying the following law:

$$\frac{V}{r} = \text{const} \qquad \text{(I)}$$

where v = liquid velocity in the gap, r = radius of gap location (moving coordinate);

because only this distribution of liquid velocities ensures a uniform degree of cleaning in each gap and, consequently, their maximum efficiency.

Such a distribution of velocities in the gaps 14 of the helix of the band 12 is achieved because the distances between each of the discs 17, 20 and the corresponding edge of the helix of the band 12 satisfy the following condition:

$$\frac{l_1}{l_2} = \frac{R^3 - r^3}{r^3 - r_o^3} \qquad \text{(II)}$$

where $l_1$ = distance between the disc 17 of the lower impeller 15 and the corresponding edge of the band 12;

$l_2$ = distance between the disc 20 of the upper impeller 16 and the corresponding edge of the band 12;

$R_2$ = maximum radius of the band helix;

r = moving radius of the band helix;

$r_o$ = minimum radius of the band helix.

In the centrifugal liquid cleaner of the above-described construction the shape of the disc 17 of the impeller 15 and the distance $l_1$ between said disc and the lower edge of the helix of the band 12 are selected so as to bring to a minimum the effect of Coriolis forces upon the cleaning of the liquid in the gaps 14 and the hydraulic resistance to be overcome by the liquid delivered to these gaps, and to ensure sliding down of sediment from the gap 14 and its maximum accumulation on the internal wall of the casing 22.

The shape of the disc 20 of the impeller 16 and the distance $l_2$ between said disc and the upper edge of the band helix are selected so as to satisfy the condition expressed in formula (II).

The centrifugal liquid cleaner functions as follows.

The liquid-filled rotor 7 is rotated by a drive (not shown) via a V-belt transmission (not shown). The liquid to be cleaned enters the centrifugal cleaner through the pipe union 3. The direction of liquid flow is shown by arrows "C". The liquid enters the radial channels through chamber "A", holes 10 in the axle 1 and chamber "B". In these radial channels the liquid is twisted by the ribs 18 of the impeller 15 to the angular velocity of the rotor 7 and enters the gap 14.

Inasmuch as the centrifugal force acting on the particle of dirt is always directly proportional to its radius while the height and length of all the gaps are the same, it means that increased efficiency of liquid cleaning requires that the time spent by the particles in the gaps of the band helix should be inversely proportional to the radius which is achieved if the liquid velocities are distributed in the gaps in accordance with the law (I). In its turn, the law (I) is ensured by carrying into effect the condition (II).

The particles whose density differs from that of the liquid being cleaned are acted upon by the centrifugal force and settle on the surface of the band 12 while the cleaned liquid is discharged to the consumer through the radial channels formed by the upper edge of the helix of the band 12, by the disc 20 and ribs 21 of the impeller 16, through the thrust disc 8, pipe 9 and pipe union 4. Uniform settling of sediment in the gaps 14 increases several times the period of continuous cleaning operation without stopping it to remove sediment from the rotor.

The above-described centrifugal liquid cleaner having a rotor 160 mm in diameter and 200 mm high revolving at 8000 rpm ensures cleaning of liquids from abrasive and metallic particles exceeding 1 micron in size with a capacity up to 40 l/min.

What we claim is:

1. A centrifugal liquid cleaner comprising: a base; a vertical hollow axle fixed rigidly on said base and provided with an inlet for the incoming liquid and an outlet for the cleaned liquid; a cylindrical rotor mounted rotatably on said hollow axle; a rotation drive of said cylindrical rotor; said cylindrical rotor comprising a bushing arranged coaxially with said hollow axle, a band secured at one end on said bushing and wound in a helix, spacers located radially one after another between the adjacent turns of the helix of said band, parallel with said hollow axle, gaps for the passage of the liquid, formed by said spacers and said band; one impeller located at the lower end of said bushing and connected to it for joint rotation, another impeller located at the upper end of said bushing and connected with it for joint rotation, each said impeller consisting of a disc and ribs secured on said disc at equal angular distances, said spacers secured by their edges in the ribs of said two impellers; discs of said impellers made and secured in such a manner that the distance between each disc and the corresponding edge of the helix of said band satisfies the condition:

$$\frac{l_1}{l_2} = \frac{R^3 - r^3}{r^3 - r_o^3}$$

where:

$l_1$ = distance between the disc of one of said impellers and the corresponding edge of the band helix;

$l_2$ = distance between the disc of the other one of said impellers and the corresponding edge of the band helix;

R = maximum radius of the helix of said band;

r = current radius of the helix of said band;

$r_o$ = minimum radius of the helix of said band;

such an arrangement of said discs relative to the edges of the helix of said band ensuring an optimum distribution of liquid flow velocities in said gaps, a casing connected with said two impellers, enclosing said bushing with the band and, both impellers and chambers which are located between the ends of said bushing with said band and said two impellers and communicate, respectively, with the liquid inlet and outlet in said hollow axle, said chambers communicating with each other through said gaps, a pressure disc mounted in said casing on said hollow axle above the other impeller.

* * * * *

UNITED STATES PATENT AND TRADEMARK OFFICE

CERTIFICATE OF CORRECTION

PATENT NO. : 4,228,948

DATED : October 21, 1980

INVENTOR(S) : Viktor A. Berber

It is certified that error appears in the above—identified patent and that said Letters Patent is hereby corrected as shown below:

References Cited change "United Kingdom...233/27" to --United Kingdom...233/30-- change "U.S.S.R....233/30" to --U.S.S.R....233/27--

Column 3, Line 6 change "venting air" to --venting out air--

Line 13 change "those" to --these--

Signed and Sealed this

*Thirty-first* Day of *March 1981*

[SEAL]

*Attest:*

RENE D. TEGTMEYER

*Attesting Officer*

*Acting Commissioner of Patents and Trademarks*